US005899148A

United States Patent [19]

Buono

[11] Patent Number: 5,899,148

[45] Date of Patent: May 4, 1999

[54] FOLDING TABLE

[75] Inventor: Steven A. Buono, Greenville, Tenn.

[73] Assignee: Meco Corporation, Greenville, Tenn.

[21] Appl. No.: 08/910,341

[22] Filed: Aug. 13, 1997

[51] Int. Cl.[6] ..... A47B 3/00

[52] U.S. Cl. ..... 108/115; 108/119

[58] Field of Search ..... 108/115, 69, 77, 108/128, 119; 248/167, 434, 188.6

[56] References Cited

U.S. PATENT DOCUMENTS

| | | | |
|---|---|---|---|
| D. 80,586 | 2/1930 | Thomas . | |
| D. 147,902 | 11/1947 | Gray . | |
| 224,799 | 2/1880 | Severson . | |
| 318,110 | 5/1885 | Harnish . | |
| 1,426,531 | 8/1922 | Albinson . | |
| 1,573,398 | 2/1926 | Griffith . | |
| 1,979,843 | 11/1934 | Roos | 108/115 X |
| 2,591,797 | 4/1952 | Exline et al. | 108/115 X |
| 3,000,679 | 9/1961 | Silverman . | |
| 3,080,193 | 3/1963 | Nimmo | 108/115 X |
| 3,124,085 | 3/1964 | Sanchez | 108/115 |
| 3,162,149 | 12/1964 | Hansen | 108/115 X |
| 3,817,191 | 6/1974 | Hansen et al. . | |
| 5,445,085 | 8/1995 | Westerburgen | 108/115 |

FOREIGN PATENT DOCUMENTS

| | | | |
|---|---|---|---|
| 2059255 | 4/1981 | United Kingdom | 108/115 |

*Primary Examiner*—Jose V. Chen
*Attorney, Agent, or Firm*—Roberts & Brownell, LLC

[57] ABSTRACT

A leg design for a folding table with rotationally attached leg segments. The folding table includes a table top with a pivoting leg, a pivoting top segment, at least one leg segment and a free standing leg. The number of pivoting legs and free standing legs can vary according to the table shape. The pivoting legs are connected to the table top by hinges. The free standing legs are connected to a leg segment by a crossbar and the leg segments rotationally interconnect with the pivoting top segment. The pivoting top segment and the leg segment or segments form a segmented leg when connected. The rotational connection allows for a free standing leg to rotate with respect to the segmented leg and the connection prevents the leg segments from separating. The free standing legs can be locked into a position that a fixed leg would normally be positioned. During disassembly, the pivoting legs are pivoted towards the table and the free standing legs are rotated towards the pivoting legs. As a result the free standing legs lay adjacent to the pivoting legs and the table top rests on top of the legs.

19 Claims, 8 Drawing Sheets

FOLDING TABLE

FIELD OF THE INVENTION

The present invention relates to a folding table and more specifically to a folding table having three or more legs, with one or more legs attached to the table top by hinges and one or more free standing legs attached to a leg that is attached to the table top. The free standing legs are attached to a pivoting leg by a crossbar in such a manner that one leg rotates with respect to the other leg. The pivoting legs can pivot with respect to the table top and the free standing legs can rotate with respect to the pivoting legs. The table can be folded with the free standing legs positioned adjacent to the pivoting legs and the table top lying on top of the legs.

BACKGROUND OF THE INVENTION

Tables come in a variety of styles and are used for a variety of reasons. Sometimes when tables are not in use they need to be stored. Non-folding tables require a large amount of storage space. A folding table offers benefits over non-folding tables in that it takes less storage space, is easy to disassemble and easy to assemble. A folding table that does not have to be disassembled for storage will reduce the possibility of pieces being lost or damaged. While folding tables already exist, new designs for such tables continue to benefit consumers by providing alternatives that may better suit a particular situation.

There thus exists a need for a folding table that is easily assembled and disassembled using a novel leg design. The present invention uses means to attach legs to a table top to provide a solid base for a table top and also allow the table to be folded in a manner that reduces the storage space for the table and keeps all of the pieces of the table attached to the table.

SUMMARY OF THE INVENTION

It is therefore an object of the present invention to allow a folding table to be assembled and disassembled in an easy manner.

A further object of the present invention is to allow the folding table to be stored with all of the pieces of the table attached to the table.

A further object of the present invention is to apply a novel folding leg design for various table shapes.

The present invention is a folding table with all of the table pieces remaining attached with the table during use and storage. The folding table includes a table top having three or more legs with one or more pivoting legs being connected to the table top by a hinged fastening means. One or more free standing legs are attached to the pivoting legs. The free standing legs and the pivoting legs are rotationally interconnected to each other. Stability of the free standing legs is achieved by the use of crossbars. By using rotational interconnections, the free standing leg can rotate and lay adjacent to the pivoting legs in the storage position. The legs can consist of segments, such that the segments are connected and can rotate, thereby allowing the legs to rotate into either a storage position or a position to support the table top. In addition, this leg design can be implemented on various shapes of table tops, such as quarter round, hemispheric, three quarter round, round, square and rectangular tables as well as other shapes.

DETAILED DESCRIPTION OF THE INVENTION

Figure 1A:
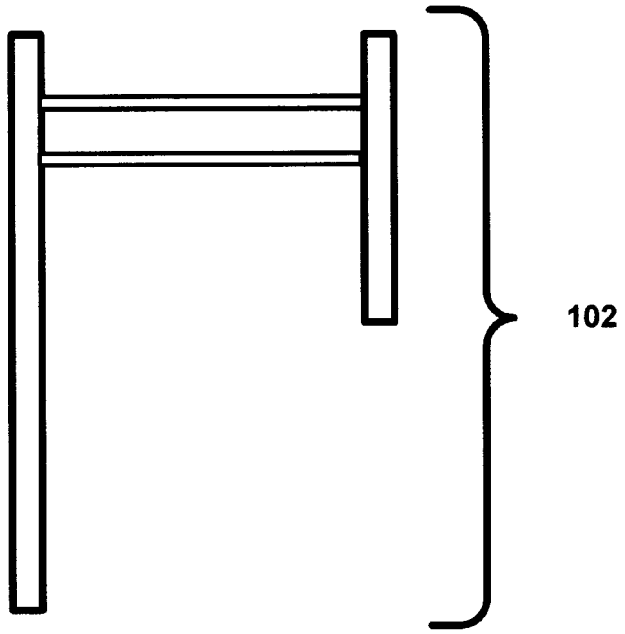
FIG. 1*a* illustrates a pivoting leg piece.
Figure 1B:
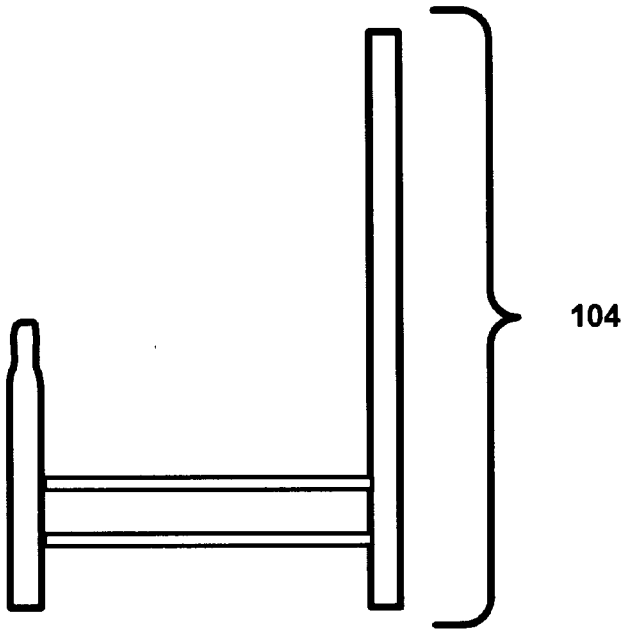
FIG. 1*b* illustrates a free standing leg piece.

FIGS. 1*a* and 1*b*, illustrate show pivoting leg piece 102 and free standing leg piece 104, respectively.

Figure 2:
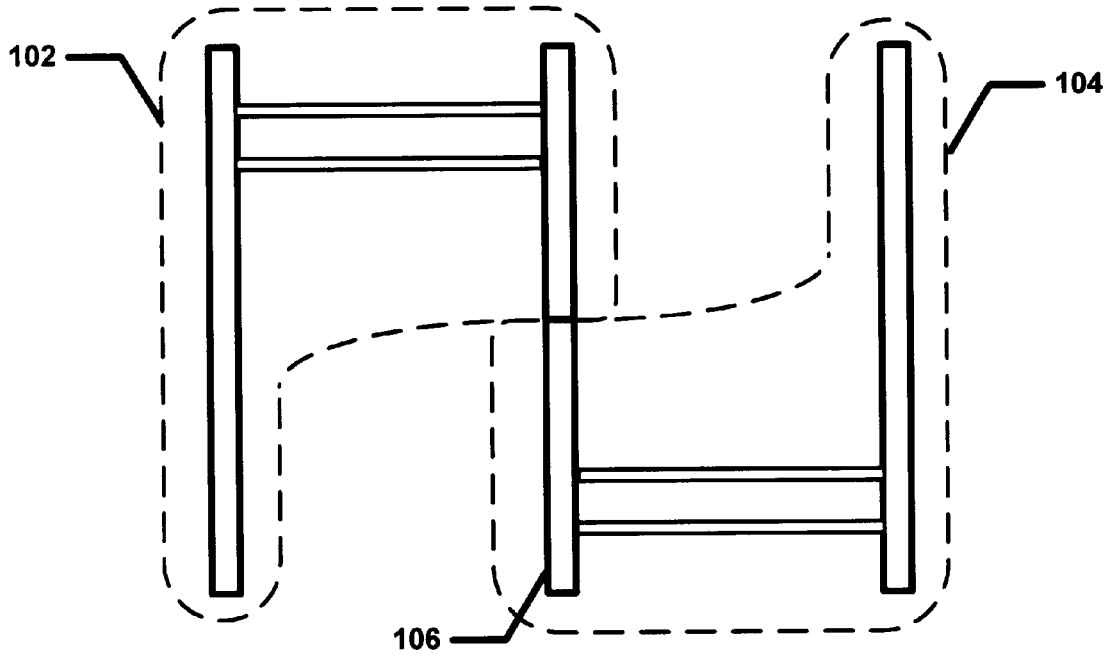
FIG. 2 illustrates a pivoting leg piece and a free standing leg piece connected together.

FIG. 2, illustrates a pivoting leg piece 102 and free standing leg piece 104 are connected together to form a third leg, segmented leg 106. This three leg design can be implemented as the leg design for a quarter round or corner table.

Figure 3B:
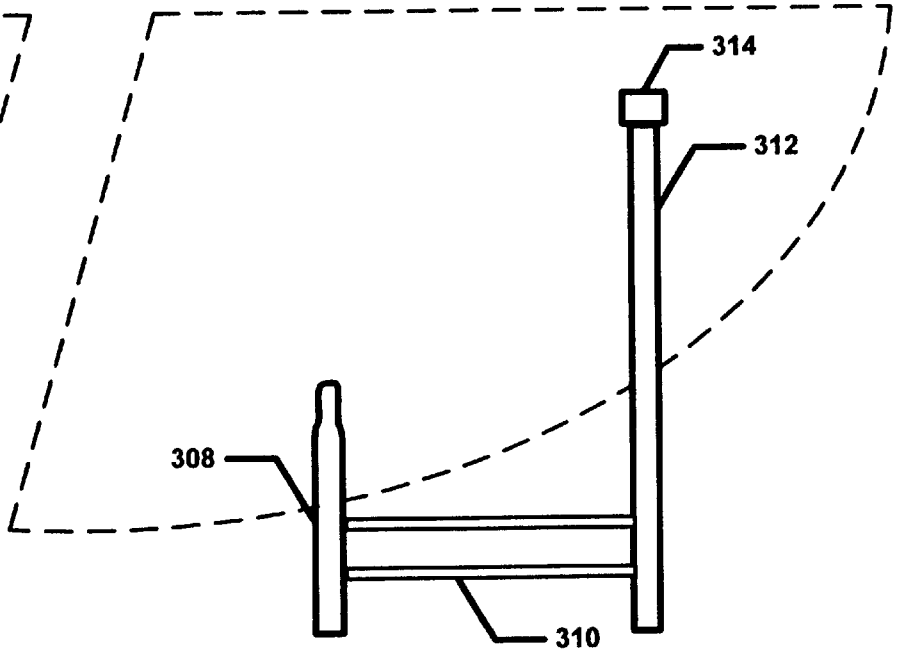
FIG. 3*b* illustrates the different parts of a free standing leg piece.
Figure 3A:
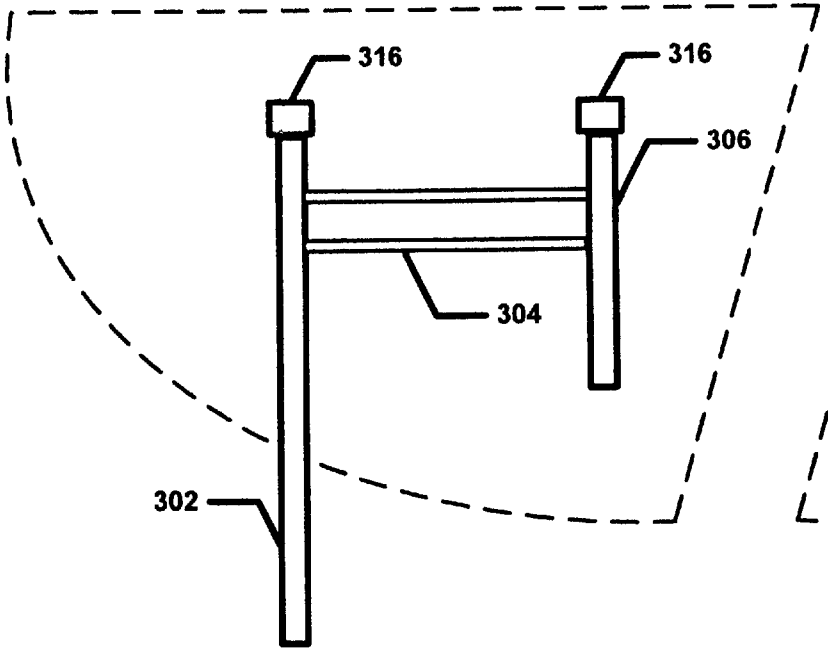
FIG. 3*a* illustrates the different parts of a pivoting leg piece.

FIG. 3*a*, illustrates pivoting leg piece (FIG. 1*a*, 102). Pivoting leg piece 102 consists of three parts: pivoting leg 302, one or more crossbar(s) 304 and pivoting top segment 306. Pivoting leg 302 is connected to pivoting top segment 306 by crossbar 304. Pivoting leg 302 and pivoting top segment 306 are attached to a table top by hinged fastening means 316. Hinged fastening means 316 allows pivoting leg 302 and pivoting top segment 306 to pivot with respect to a table top. When the table is folded, pivoting leg 302 and pivoting top segment 306 can either pivot towards the table top or the table top can pivot towards pivoting leg 302 and pivoting top segment 306. The hinged fastening means can consist of any suitable hinges that are known to one skilled in the art.

One of the purposes of crossbar 304 is to provide stability to pivoting leg 302 and pivoting top segment 304. However in another embodiment, pivoting leg 302 and pivoting top segment 306 can be hinged to the table top and not connected to each other by a crossbar.

FIG. 3*b* illustrates the parts of free standing leg piece (FIG. 1*b*, 104). Free standing leg piece 104 consists of three parts: free standing leg 312, one or more crossbar(s) 310 and bottom segment 308. Where free standing leg 312 is connected to bottom segment 308 by crossbar 310.

As illustrated in FIGS. 3*a* and 3*b* and depicted in FIG. 2, pivoting leg piece 102 and free standing leg piece 104 are connected together to form segmented leg 106. Pivoting top segment 302 and bottom segment 308 connect to form segmented leg 106. These segments are interconnected together to allow bottom segment 308 to rotate with respect to pivoting top segment 306, thereby allowing free standing leg piece 104 to rotate with respect to pivoting leg piece 102.

Since free standing leg piece 104 can rotate, free standing leg piece 104 can be positioned to properly distribute the weight of a table top and to provide a stable base for the table top. In another embodiment, locking means 314 can lock free standing leg 312 to the bottom of a table top. Locking means 314 can consist of any suitable locking means that is known to one skilled in the art. Locking means 314 allows free standing leg 312 to be locked into a position, i.e., the position where a permanently attached fixed leg would be positioned. In addition, free standing leg piece 104 can rotate with respect to pivoting leg piece 102, thereby allowing free standing leg piece 104 to rotate to a position adjacent to pivoting leg piece 102 for storage purposes. Once free standing leg piece 104 is adjacent to pivoting leg piece 102, the table top can be folded on top of the three legs.

Figure 4:
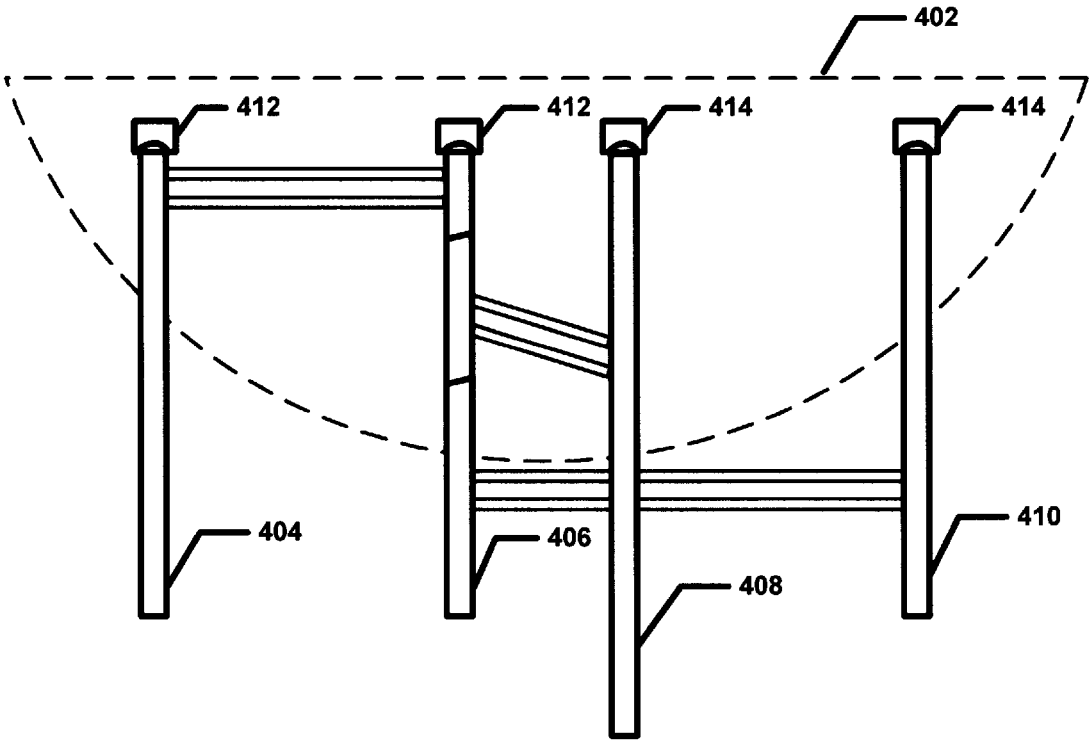
FIGS. 4 illustrates a folding table having four legs.

FIG. 4 illustrates an alternative embodiment for a table with four legs. The folding table consists of table top 402 and the three leg pieces, pivoting leg piece 404, free standing leg piece 408 and free standing leg piece 410. FIG.4 also illustrates hinged fastening means 412 and locking means 414 as used in a preferred embodiment of the present invention.

Figures 5A, 5B, 5C:
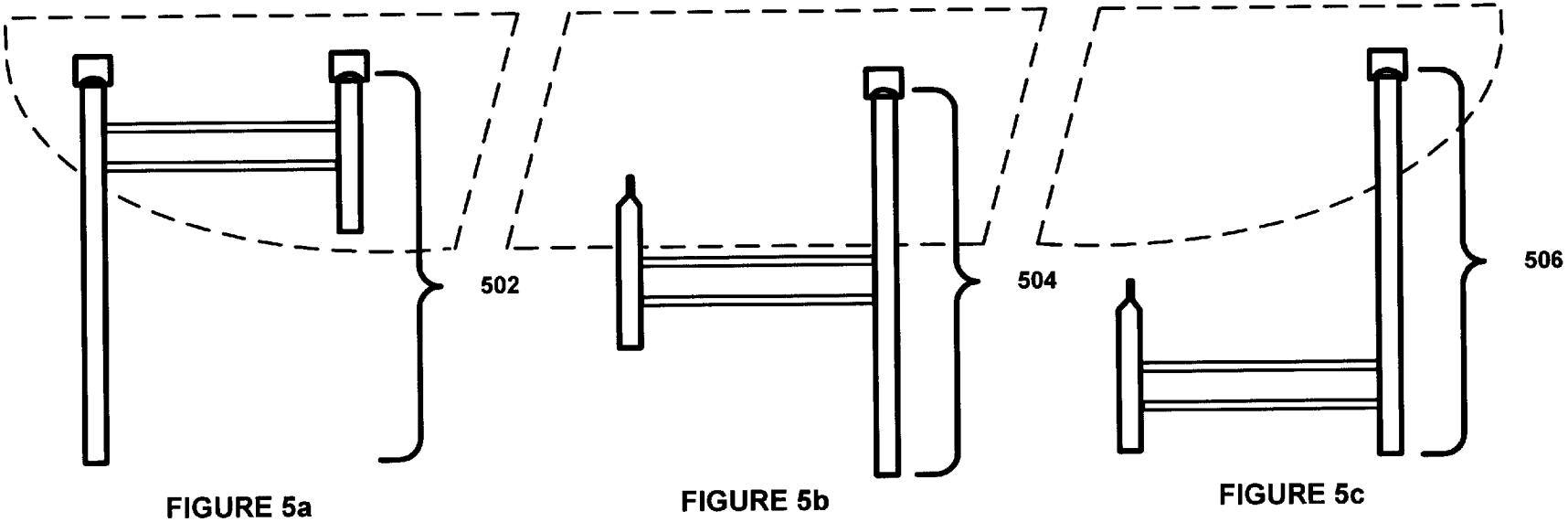
FIG. 5*a* illustrates a pivoting leg piece with a pivoting top segment.
FIG. 5*b* illustrates a free standing leg piece with a middle segment.
FIG. 5*c* illustrates a free standing leg piece with a bottom segment.

FIGS. 5*a*, 5*b* and 5*c* illustrate pivoting leg piece 502, free standing leg piece 504 and free standing leg piece 506, respectively.

Figures 6A, 6B, 6C:
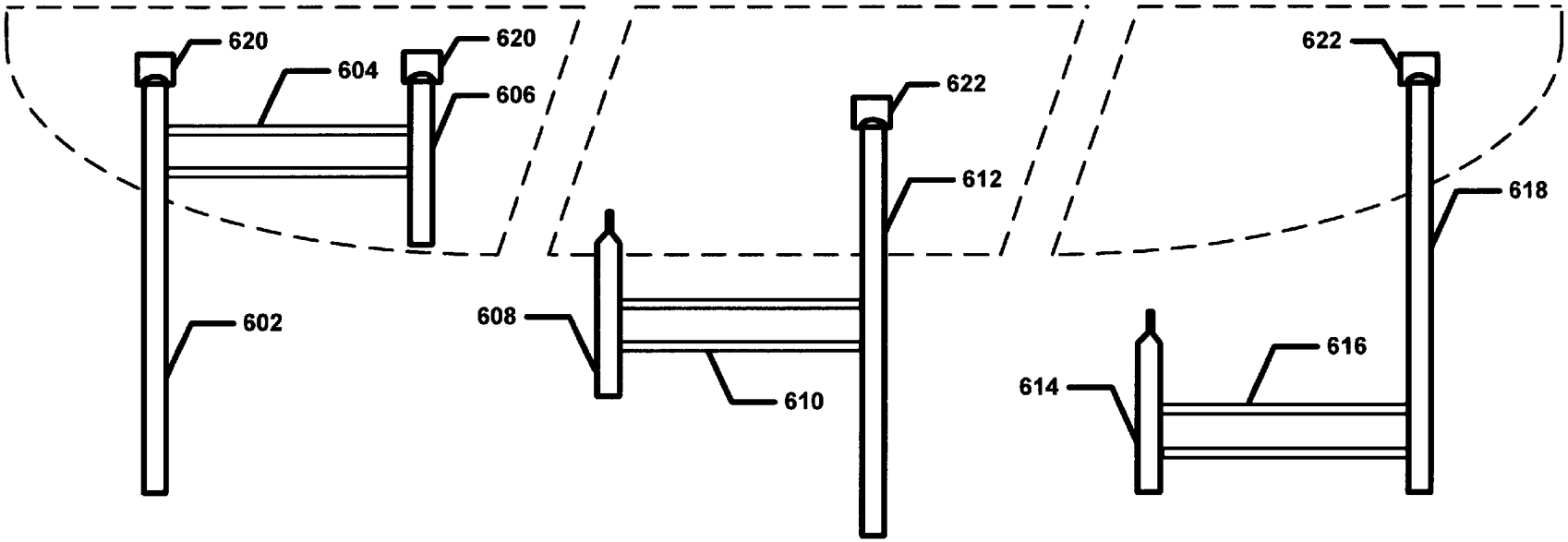
FIG. 6*a* illustrates the different parts of a pivoting leg piece with a pivoting top segment.
FIG. 6*b* illustrates the different parts of a free standing leg piece with a middle segment.
FIG. 6*c* illustrates the different parts of a free standing leg piece with a bottom segment.

FIG. 6*a* illustrates the parts of pivoting leg piece (FIG. 5*a*, 502). Pivoting leg piece 502 consists of three parts: pivoting leg 602, one or more crossbar(s) 604 and pivoting top segment 606, where pivoting leg 602 is connected to pivoting top segment 606 by crossbar 604. Pivoting leg 602 and pivoting top segment 606 are attached to table top 402 of FIG. 4, by hinged fastening means 620. Hinged fastening means 620 allows pivoting leg 602 and pivoting top segment 606 to pivot with respect to table top 402. Hinged fastening means 620 can consist of any suitable hinges that are known to one skilled in the art.

FIG. 6*b* illustrates the parts of free standing leg piece (FIG. 5*b*, 504). Free standing leg piece 504 consists of three parts: free standing leg 612, one or more crossbar(s) 610 and middle segment 608. Where free standing leg 612 is connected to middle segment 608 by crossbar 610.

FIG. 6*c* illustrates the parts of free standing leg piece (FIG. 5*c*, 506). Free standing leg piece 506 consists of three parts: free standing leg 618, one or more crossbar(s) 616 and bottom segment 614. Where free standing leg 618 is connected to bottom segment 614 by crossbar 616.

As illustrated in FIGS. 6*a*, 6*b* and 6*c* and depicted in FIG. 4, pivoting top segment 606 has an opening on the bottom end, which is capable of receiving the top end of middle segment 608, thereby allowing pivoting top segment 606 and middle segment 608 to be interconnected. Middle segment 608 also has an opening on the bottom end, which is capable of receiving the top end of bottom segment 614, thereby allowing middle segment 608 and bottom segment 614 to be interconnected. When pivoting top segment 606, middle segment 608 and bottom segment 614 are connected together, they form segmented leg 406 as illustrated in FIG. 4. The interconnection between the segments is further depicted in FIG. 7.

As depicted in FIG. 4, segmented leg 406 is connected to pivoting leg 404, free standing leg 408 and free standing leg 410. Free standing leg 408 is connected to segmented leg 406 by middle section 608 and connected top section 606. This connection allows free standing leg 408 to rotate with respect to segmented leg 406. Free standing leg 410 is connected to segmented leg 406 by bottom segment 614 and middle segment 608. This connection allows free standing leg 410 to rotate with respect to segmented leg 406. Free standing legs 408 and 410 can be positioned to properly distribute the weight of a table top and to provide a stable base for a table top. The free standing legs can be locked into a position using locking means 622 as known to one skilled in the art.

The folding table in FIG. 4 can be folded. In order to fold the table, free standing leg pieces 504 and 506 are rotated to lay adjacent to pivoting leg piece 502. In the folded position, free standing legs 612 and 618 are rotated to lay adjacent to pivoting leg 602. Pivoting leg 602 and pivoting top segment 606 pivot with respect to table top 402. As a result, free standing leg 410 or 408 lays on top of the other, and on top of pivoting leg 404, with table top 402 laying on top of pivoting leg piece 502.

Figure 7:
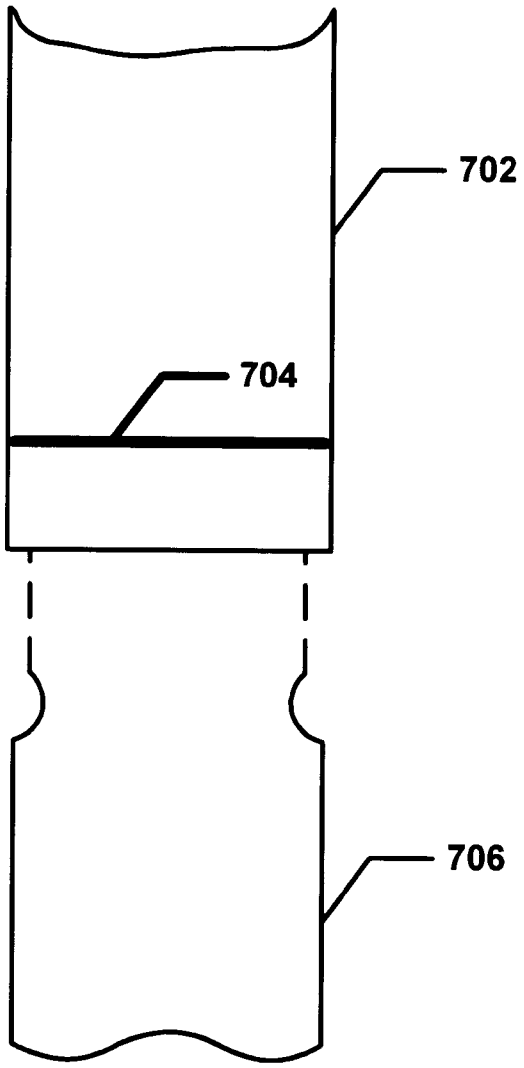
FIG. 7 illustrates the connection between the segments of a leg.

FIG. 7 illustrates the connections between segments. Section 702 has an opening on the bottom end, which is capable of receiving the top end of segment 706, thereby allowing segments 702 and 706 to be connected. The top end of segment 706 nests in the lower end of segment 702. Segments 702 and 706 need to be interconnected in such a manner to allow the segments to rotate with respect to each other. One of the objects of this invention is to allow a folding table to keep all of the parts of the table connected, therefore the interconnected segments should interconnect in such a manner as to allow the segments to rotate and also prevent the segments from separating from each other. As illustrated in FIG. 7, at least one depression 704 is formed around the circumference of segment 702. Depression 704 penetrates to such a point as to hold segment 706 in contact within segment 702. In another embodiment, segment 706 can include a corresponding depression such that depression 704 and the depression in segment 706 will line up to prevent segments 702 and 706 from separating. The interconnecting segments can be connected in any suitable manner as known to one skilled in the art, that allows the connected segments to rotate with respect to one another.

Other embodiments can be made using the leg design of the present invention. Folding tables having multiple legs can be implemented. These embodiments can consist of multiple pivoting legs and multiple free standing legs. The pivoting legs can have multiple free standing leg(s) connected to them and the free standing legs can have additional free standing leg(s) attached to them as well. The number of segments making up a segmented leg can also vary accordingly. For instance, a segmented leg can consist of a pivoting top segment, at least two middle segments and a bottom segment.

In another embodiment, a crossbar can connect to a leg in such a manner as to allow the crossbar to rotate around a leg instead of the segment rotating with respect to the other segment. The crossbars as shown in the figures consisted of two bars, however the crossbars can consist of various designs that are known to one skilled in the art.

Figure 8:
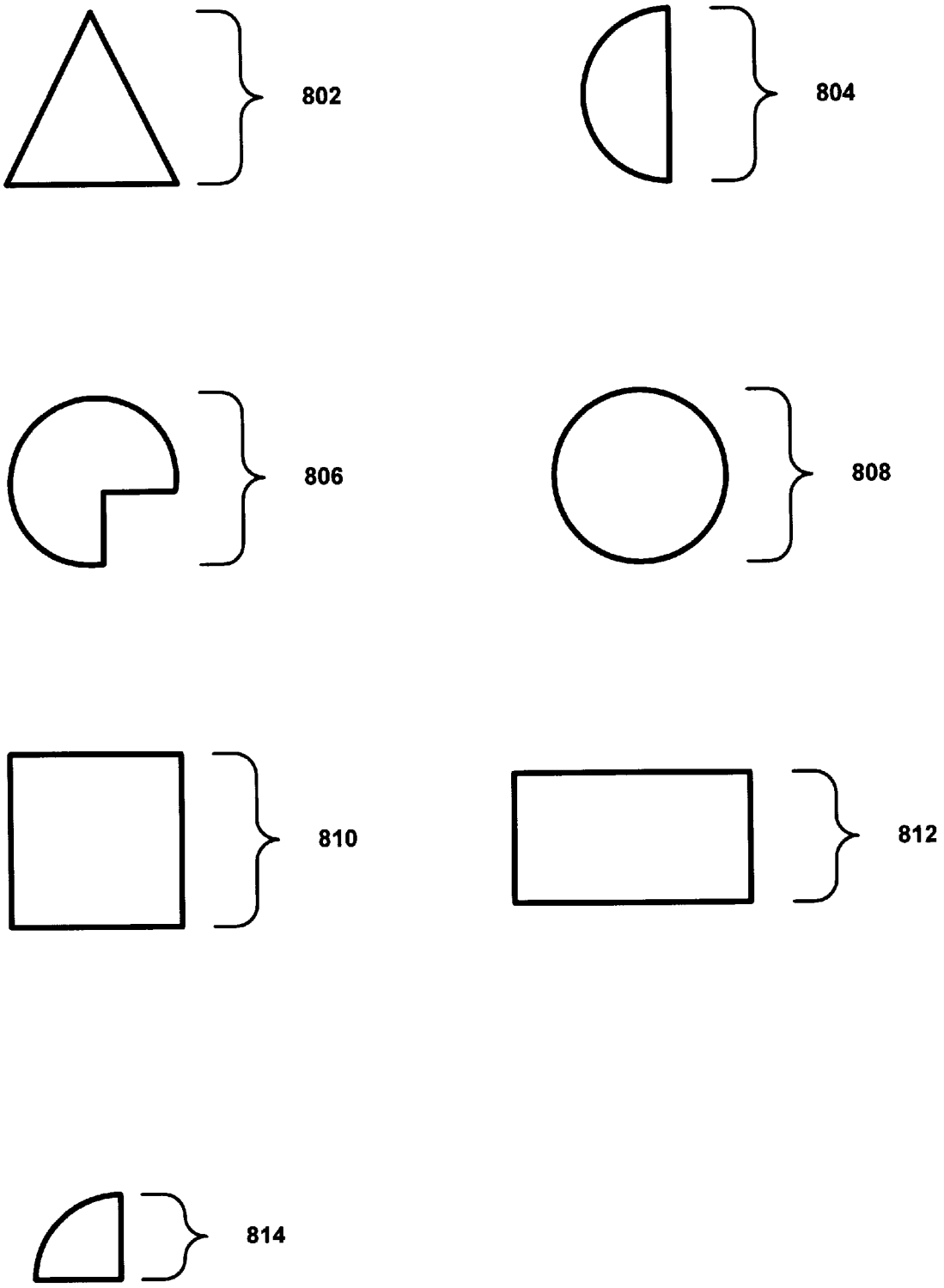
FIGS. 8*a–g* illustrates different shapes of the table top.

As illustrated by FIG. 8, the shape of the table top can vary. Typically the three leg design would be used with a triangular shaped table 802 (i.e. a corner table) and the four leg design can be used with hemispheric 804, three quarter round 806, round 808, square 810 and rectangular 812 shaped tables. The leg design can be implemented in a variety of designs to meet any table shape, such as quarter round 814, hemispheric 804, three quarter round 806, round 808, square 810 and rectangular 812 tables as well as other shapes.

Although the apparatus of the present invention has been described in detail for purpose of illustration, it is understood that such detail is solely for that purpose, and variations can be made therein by those skilled in the art without departing from the scope of the invention. The apparatus of the present invention is defined by the following claims:

We claim:

1. A folding table comprising:

a table top having a bottom;

at least one segmented leg comprising:

a pivoting top segment; and a bottom segment, where the pivoting top segment and the bottom segment are rotationally connected to one another;

at least one pivoting leg further comprising at least one crossbar connecting the pivoting leg to the pivoting top segment, where the pivoting leg and the pivoting top segment are connected to the table top by a hinged fastening means; and at least one free standing leg further comprising at least one crossbar connecting the free standing leg to the bottom segment, where the pivoting top segment rotationally interconnects with the bottom segment.

2. A folding table as in claim 1, where the bottom segment has an upper end and the pivoting top segment has a lower end, and where the upper end of the bottom segment nests in the lower end of the pivoting top segment.

3. A folding table as in claim 2, where at least one depression is formed around the circumference of pivoting top segment to hold the upper end of the bottom segment in place and to allow the bottom segment to rotate with respect to the pivoting top segment.

4. A folding table as in claim 3, where at least one corresponding depression is formed around the circumference of the bottom segment, where the depression of the pivoting top segment and the corresponding depression of the bottom segment line up to prevent the segments from separating.

5. A folding table as in claim 1, where the free standing leg attaches to the bottom of the table top by a locking means.

6. A folding table as in claim 1, where the shape of the table top is selected from the group consisting of triangular, quarter round, hemispheric, three quarter round, round, square and rectangular.

7. A folding table comprising:

a table top having a bottom;

at least one segmented leg comprising:

a pivoting top segment; and a bottom segment, where the pivoting top segment and the bottom segment are rotationally connected to one another;

at least one pivoting leg further comprising at least one crossbar connecting the pivoting leg to the pivoting top segment, where the pivoting leg and pivoting top segment are connected to the table top by a hinged fastening means;

at least one free standing leg further comprising at least one crossbar connecting the free standing leg to a middle segment; and at least one free standing leg further comprising at least one crossbar connecting the free standing leg to the bottom segment, where the pivoting top segment rotationally interconnects with the middle segment and the middle segment rotationally interconnects with the bottom segment.

8. A folding table as in claim 7, where the pivoting top segment has a lower end, the middle segment has an upper end and a lower end, and the bottom segment has an upper end, and where the upper end of the middle segment nests in the lower end of the pivoting top segment and the upper end of the bottom segment nests in the lower end of the middle segment.

9. A folding table as in claim 8, where at least one depression is formed around the circumference of pivoting top segment to hold the upper end of the middle segment in place and to allow the middle segment to rotate with respect to the pivoting top segment and at least one depression is formed around the circumference of middle segment to hold the upper end of the bottom segment in place and to allow the bottom segment to rotate with respect to the middle segment.

10. A folding table as in claim 9, where at least one corresponding depression is formed around the circumference of the middle segment, where the depression of the pivoting top segment and the corresponding depression of the middle segment line up to prevent the segments from separating and at least one corresponding depression is formed around the circumference of the middle segment, where the depression of the middle segment and the corresponding depression of the bottom segment line up to prevent the segments from separating.

11. A folding table as in claim 7, where at least one of the free standing legs attaches to the bottom of the table top by a locking means.

12. A folding table as in claim 7, where the shape of the table top is selected from the group consisting of triangular, quarter round, hemispheric, three quarter round, round, square and rectangular.

13. A folding table comprising:

a table top having a bottom;

at least one pivoting leg attached to the bottom of the table top by a hinged fastening means;

at least one pivoting top segment attached to the bottom of the table top by a hinged fastening means; and at least one free standing leg further comprising at least one crossbar connecting the free standing leg to a bottom segment, where the pivoting top segment rotationally interconnects with the bottom segment to form a segmented leg.

14. A folding table as in claim 13, where at least one crossbar connects the pivoting leg to the pivoting top segment.

15. A folding table as in claim 13, where the bottom segment has an upper end and the pivoting top segment has a lower end, and where the upper end of the bottom segment nests in the lower end of the pivoting top segment.

16. A folding table as in claim 15, where at least one depression is formed around the circumference of pivoting top segment to hold the upper end of the bottom segment in place and to allow the bottom segment to rotate with respect to the pivoting top segment.

17. A folding table as in claim 16, where at least one corresponding depression is formed around the circumference of the bottom segment, where the depression of the pivoting top segment and the corresponding depression of the bottom segment line up to prevent the segments from separating.

18. A folding table as in claim 13, where the free standing leg locks to the bottom of the table top by a locking means.

19. A folding table as in claim 13, where the shape of the table top is selected from the group consisting of triangular, quarter round, hemispheric, three quarter round, round, square and rectangular.

* * * * *